US007384121B2

(12) United States Patent
Nishi et al.

(10) Patent No.: US 7,384,121 B2
(45) Date of Patent: Jun. 10, 2008

(54) CLEANER OF LIQUID DISCHARGER HEAD AND LIQUID DISCHARGER

(75) Inventors: Shota Nishi, Kanagawa (JP); Yuji Yakura, Kanagawa (JP); Masayuki Takakura, Kanagawa (JP); Shinichi Horii, Kanagawa (JP)

(73) Assignee: Sony Corporation, Tokyo (JP)

( * ) Notice: Subject to any disclaimer, the term of this patent is extended or adjusted under 35 U.S.C. 154(b) by 320 days.

(21) Appl. No.: 11/110,526

(22) Filed: Apr. 20, 2005

(65) Prior Publication Data

US 2005/0229843 A1 Oct. 20, 2005

(30) Foreign Application Priority Data

Apr. 22, 2004 (JP) ..... P2004-126355

(51) Int. Cl.
*B41J 2/165* (2006.01)

(52) U.S. Cl. ..... 347/33; 347/29; 347/32

(58) Field of Classification Search ..... 347/33, 347/29, 32
See application file for complete search history.

(56) References Cited

U.S. PATENT DOCUMENTS 6,460,967 B1 * 10/2002 Makita et al. ..... 347/33

FOREIGN PATENT DOCUMENTS

JP 06-000965 1/1994
JP 11-221928 8/1999

OTHER PUBLICATIONS

Japanese Office Action issued on Sep. 25, 2007.

* cited by examiner

*Primary Examiner*—Shih-Wen Hsieh
(74) *Attorney, Agent, or Firm*—Sonnenschein Nath & Rosenthal LLP

(57) ABSTRACT

A cleaner of a liquid discharge head having a nozzle surface provided with a liquid discharge nozzle for discharging a predetermined liquid cleans the nozzle surface by moving relative to the liquid discharge head. It includes a cleaning roller for wiping the nozzle surface, the surface of the cleaning roller which comes into contact with the nozzle surface being formed of a fibrous absorbing member.

6 Claims, 6 Drawing Sheets

CLEANER OF LIQUID DISCHARGER HEAD AND LIQUID DISCHARGER

CROSS REFERENCES TO RELATED APPLICATIONS

The present invention contains subject matter related to Japanese Patent Application JP 2004-126355 filed in the Japanese Patent Office on Apr. 22, 2004, the entire contents of which are incorporated herein by reference.

BACKGROUND OF THE INVENTION

1. Field of the Invention

The present invention relates to a cleaner of a liquid discharge head which discharges a predetermined liquid from liquid discharge nozzles, and a liquid discharger including the cleaner.

2. Description of the Related Art

In the past, for example, an inkjet printer has been in widespread use as a liquid discharger which discharges from liquid discharge nozzles a predetermined liquid supplied in a liquid discharge head. The inkjet printer performs printing by discharging a very small quantity of ink drops onto a recording sheet from the very small ink discharge nozzles disposed at a nozzle surface of a print head.

In the inkjet printer, if the ink drops are not discharged from the ink discharge nozzles of the print head because the print head does not perform a printing operation for a long period of time, any ink remaining near any of the ink discharge nozzles by previous printing may thicken and harden as a result of undergoing evaporation drying. Therefore, it becomes difficult to properly discharge the ink in subsequent printing operations, as a result of which print quality may be reduced.

Therefore, in the past, the nozzle surface of the print head has been cleaned by wiping and removing the ink that has adhered to the nozzle surface, thickened, and hardened as a result of pushing and sliding a blade, formed of, for example, a somewhat hard rubber, along the nozzle surface of the print head. In relation to this, a technology for further increasing the wiping effect by rotating a plurality of blades mounted to a rotary shaft is disclosed in, for example, Japanese Unexamined Patent Application Publication No. 57-34969 (Patent Document 1).

A wiping member formed of a porous cellular material has been proposed as an improvement of wiping members such as a cleaning blade and a cleaning roller for wiping the nozzle surface of the print head. The improved wiping member wipes any foreign material or dirt while absorbing any ink adhered to the nozzle surface of the print head by making use of capillary force generated in cells formed in the porous cellular material. Making the average of the diameters of the cells formed in the cellular material equal to or less than the diameter of the ink discharge nozzles makes it possible to expect an excellent cleaning effect. (Refer to, for example, Japanese Unexamined Patent Application Publication No. 2738855 (Patent Document 2)).

SUMMARY OF THE INVENTION

In the technology disclosed in Patent Document 1, since the ink adhered to the nozzle surface is wiped by sliding a blade, formed of, for example, a somewhat hard rubber, along the nozzle surface of the print head while the blade is pushed against the nozzle surface, a large force is applied to the nozzle surface by the blade. This may scratch the nozzle surface. Although, when the blade is used, its wiping effect alone must be depended upon, the ink cannot be completely removed from the ink discharge nozzle by only wiping.

Even if a plurality of blades are used, similarly to the above case, the ink discharge surface may become scratched, and ink remains near the ink discharge nozzles. Therefore, ink discharge failure occurs.

In the technology in Patent Document 2, the average of the diameters of the cells formed in the cellular material of which the cleaning roller is formed can be controlled by the conditions of producing the porous cellular material. However, the diameters of the cells in the cellular material vary greatly depending upon, for example, the manufacturing temperature, humidity, or lot.

Since it is difficult to stabilize the average of the diameters of the cells in the cellular material, mass production of products of the same standard cannot be easily achieved. Therefore, the technology in Patent Document 2 is not suitable for mass production.

Further, the cells in the cellular material may become deformed by press-contacting the cleaning roller against the nozzle surface of the print head. Therefore, it is not easy to set the diameters of the cells in the cellular material on the order of a micron considering the state of use of the cleaning roller.

As a result, when the nozzle surface of the print head is wiped with such a cleaning roller, the ink on the nozzle surface may not be uniformly wiped.

It is desirable to provide a cleaner of a liquid discharge head for increasing the cleaning effect at a nozzle surface of the liquid discharge head by absorbing any liquid adhered to the nozzle surface and removing any dirt with a cleaning roller whose surface which comes into contact with the nozzle surface is formed of a fibrous absorbing member, and to provide a liquid discharger including the cleaner.

A cleaner according to an embodiment of the present invention of a liquid discharge head having a nozzle surface provided with a liquid discharge nozzle for discharging a predetermined liquid cleans the nozzle surface by moving relative to the liquid discharge head. The cleaner includes a cleaning roller for wiping the nozzle surface, the surface of the cleaning roller which comes into contact with the nozzle surface being formed of a fibrous absorbing member.

By virtue of this structure, by moving the cleaning roller relative to the liquid discharge head, any liquid adhered to the nozzle surface is absorbed and any dirt is removed, so that the cleaning effect at the nozzle surface is enhanced. Therefore, the stability with which liquid is discharged from the liquid discharge head can be increased.

A liquid discharger according to another embodiment of the present invention for discharging a predetermined liquid from a liquid discharge nozzle includes a liquid discharge head having a nozzle surface provided with the liquid discharge nozzle for discharging the predetermined liquid, and a cleaner for cleaning the nozzle surface by moving relative to the liquid discharge head. The cleaner includes a cleaning roller for wiping the nozzle surface, the surface of the cleaning roller which comes into contact with the nozzle surface of the liquid discharge head being formed of a fibrous absorbing member. The cleaning roller moves in a direction perpendicular to a longitudinal direction of the nozzle surface.

By virtue of this structure, by moving the cleaning roller relative to the liquid discharge head, any liquid adhered to the nozzle surface is absorbed and any dirt is removed, so that the cleaning effect at the nozzle surface is enhanced.

Therefore, the stability with which liquid is discharged from the liquid discharge head can be increased.

The cleaning roller moves along the nozzle surface as it rotates while being in press-contact with the nozzle surface in order to absorb any liquid adhered to the nozzle surface and to remove any dirt. Therefore, the cleaning effect at the nozzle surface can be enhanced.

Since a length that is an integral multiple of a cross-sectional boundary length of the cleaning roller differs in value from a distance that the cleaning roller moves as it rotates while being in press-contact with the nozzle surface, it is possible to repeatedly wipe the nozzle surface while varying a portion where the outer peripheral surface of the cleaning roller contacts the nozzle surface. Therefore, it is possible to enhance the cleaning effect at the nozzle surface by removing any dirt adhered to the nozzle surface with the fibrous absorbing member disposed at the outer peripheral surface of the cleaning roller.

Since the cleaning roller wipes the nozzle surface with a wipe start position where wiping is started with respect to the nozzle surface being different from a previous wipe start position, it is possible to repeatedly wipe the nozzle surface while varying the portion where the outer peripheral surface of the cleaning roller contacts the nozzle surface. Therefore, it is possible to enhance the cleaning effect at the nozzle surface by removing any dirt adhered to the nozzle surface with the fibrous absorbing member disposed at the outer peripheral surface of the cleaning roller.

DESCRIPTION OF THE PREFERRED EMBODIMENT

Figure 1:
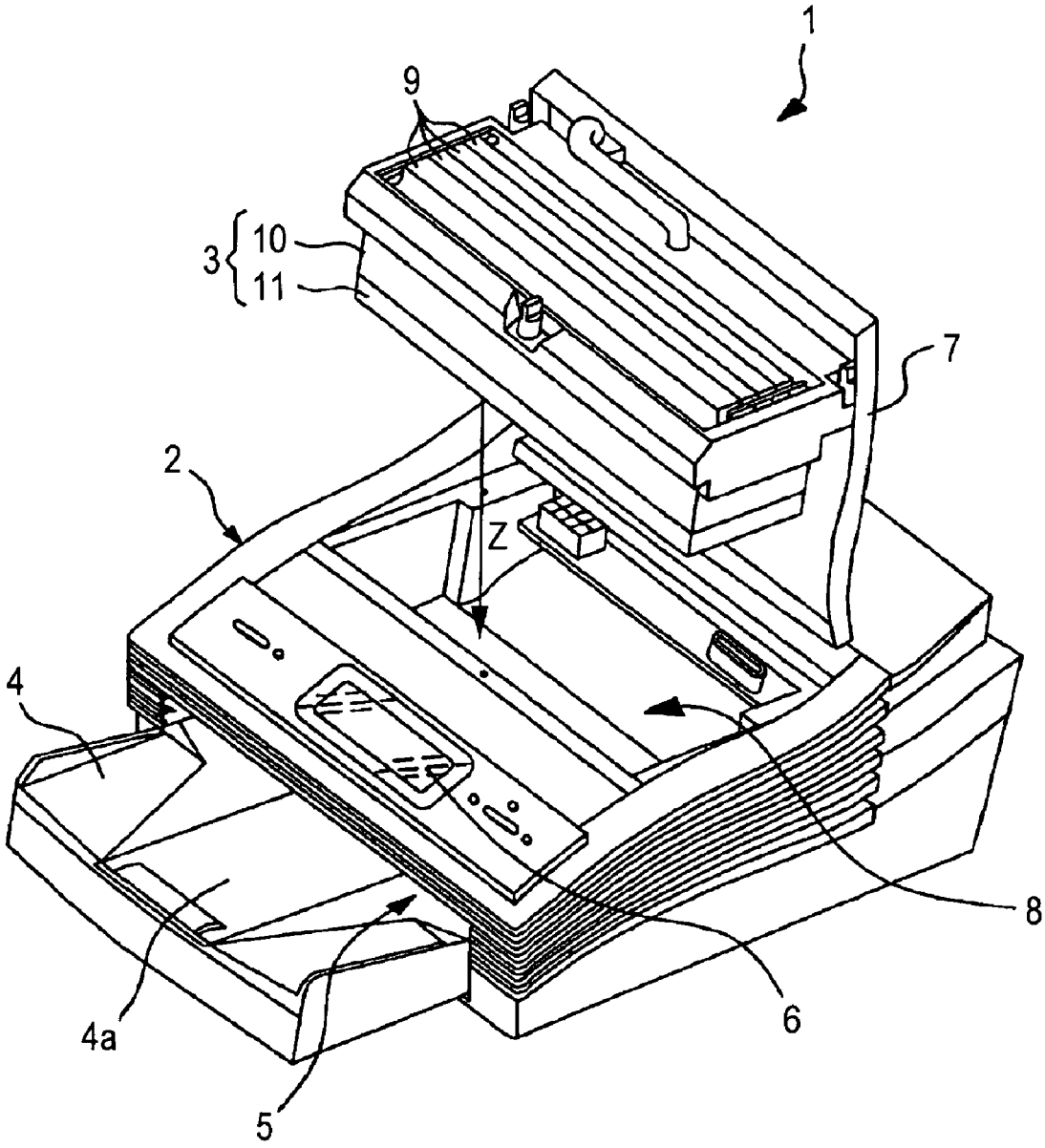
FIG. 1 is a perspective view of an inkjet printer which is an example of a liquid discharger in accordance with an embodiment of the present invention.

An embodiment of the present invention will hereunder be described in detail with reference to the attached drawings. FIG. 1 is a perspective view of an inkjet printer which is an example of a liquid discharger in accordance with an embodiment of the present invention. An inkjet printer 1 forms an image by discharging ink drops onto a recording sheet, and includes a printer body 2, a head cartridge 3 (see FIG. 2), and a recording-sheet tray 4.

A transportation mechanism for transporting recording sheets (discharge objects) accommodated in the recording-sheet tray 4 and a controller unit for performing suitable printing on the recording sheets are accommodated in the printer body 2 shown in FIG. 1. The recording-sheet tray 4 is removably mounted to a tray insertion slot 5 formed in the lower front portion of the printer body 2.

The tray insertion slot 5 is also a recording sheet discharge slot. A recording sheet on which printing has been performed in the printer body 2 is discharged from a sheet-discharge receiver 4*a* at the upper side of the recording-sheet tray 4. A display panel 6 for displaying the state of the operation of the entire inkjet printer 1 is disposed on the upper front portion of the printer body 2.

A top cover 7 is mounted to the top surface of the printer body 2 so as to be openable and closable. When the top cover 7 is opened, an accommodation section 8 for accommodating the head cartridge 3 can be seen being disposed in the upper surface of the printer body 2. The accommodation section 8 of the printer body 2 accommodates the head cartridge 3 in the direction of arrow Z, and removably holds the head cartridge 3.

The head cartridge 3 includes four ink tanks 9, a print head 10, and a head cap 11. A housing of the head cartridge 3 extends so as to be elongated in the widthwise direction of the printer body 2, that is, over the entire width in the widthwise direction of a recording sheet. The head cartridge 3 is used to form an image by discharging, for example, ink types of four colors, yellow Y, magenta M, cyan C, and black K, on the recording sheet.

Figure 2:
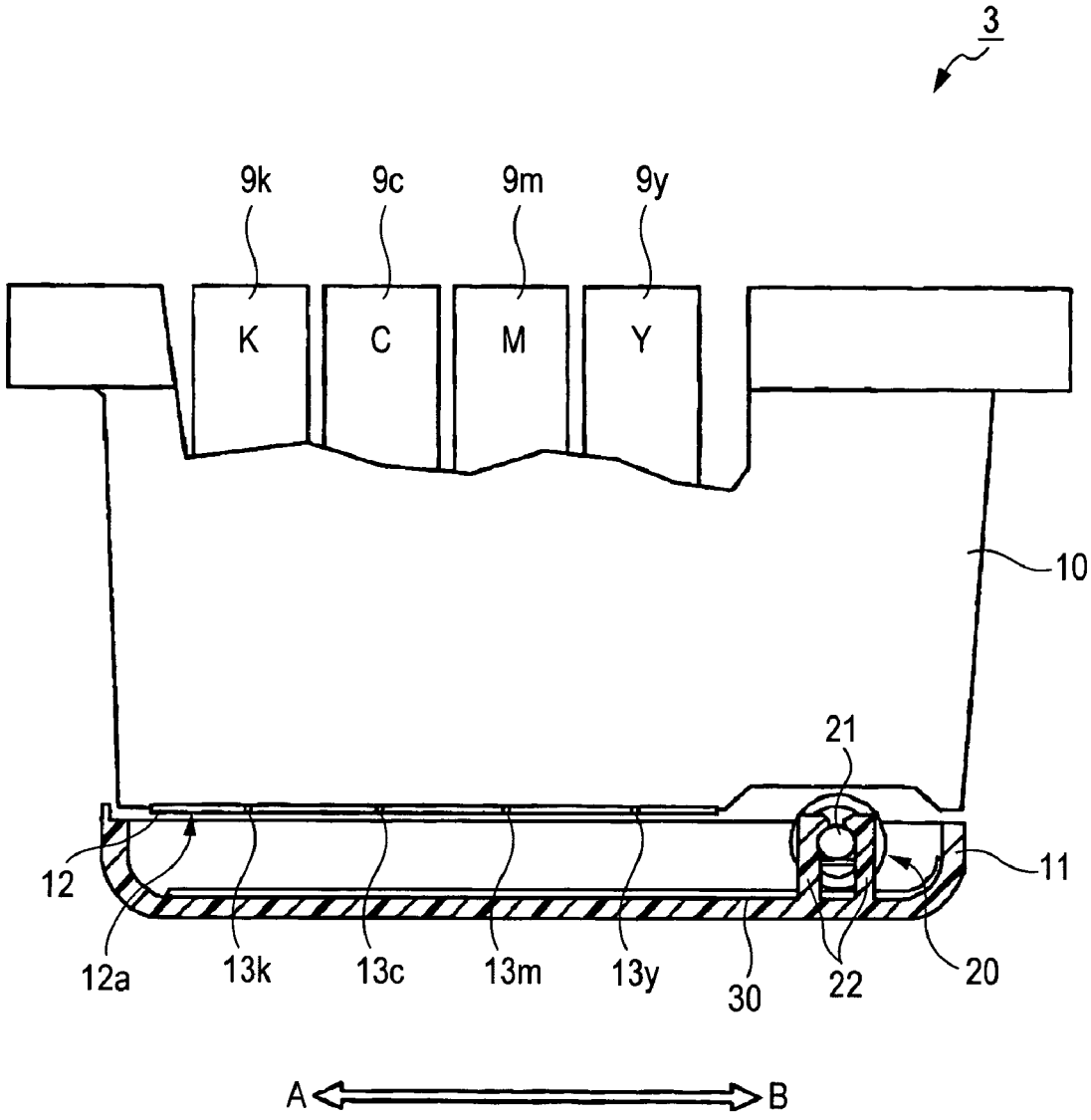
FIG. 2 is a partial sectional side view of the structure of a head cartridge accommodated in an accommodation section of the inkjet printer shown in FIG. 1.

FIG. 2 is a partial sectional side view of the structure of the head cartridge 3 shown in FIG. 1. The four ink tanks 9 (9*y*, 9*m*, 9*c*, and 9*k*) are mounted in the head cartridge 3. The ink tanks 9 are liquid containers storing ink (predetermined liquid), that is, the ink types of the four colors Y, M, C, and K.

The ink contained in the ink tanks 9 is supplied to the print head 10. The print head 10 is what is called a full-line liquid discharge head for discharging ink in accordance with the entire length of a recording sheet from the ink tanks 9. A nozzle member 12 forming a nozzle surface 12*a* is disposed at the lower surface of the print head 10. A row of ink discharge nozzles (liquid discharge nozzles) 13 are disposed at the nozzle member 12 in correspondence with the entire width of a recording sheet.

Figure 3:
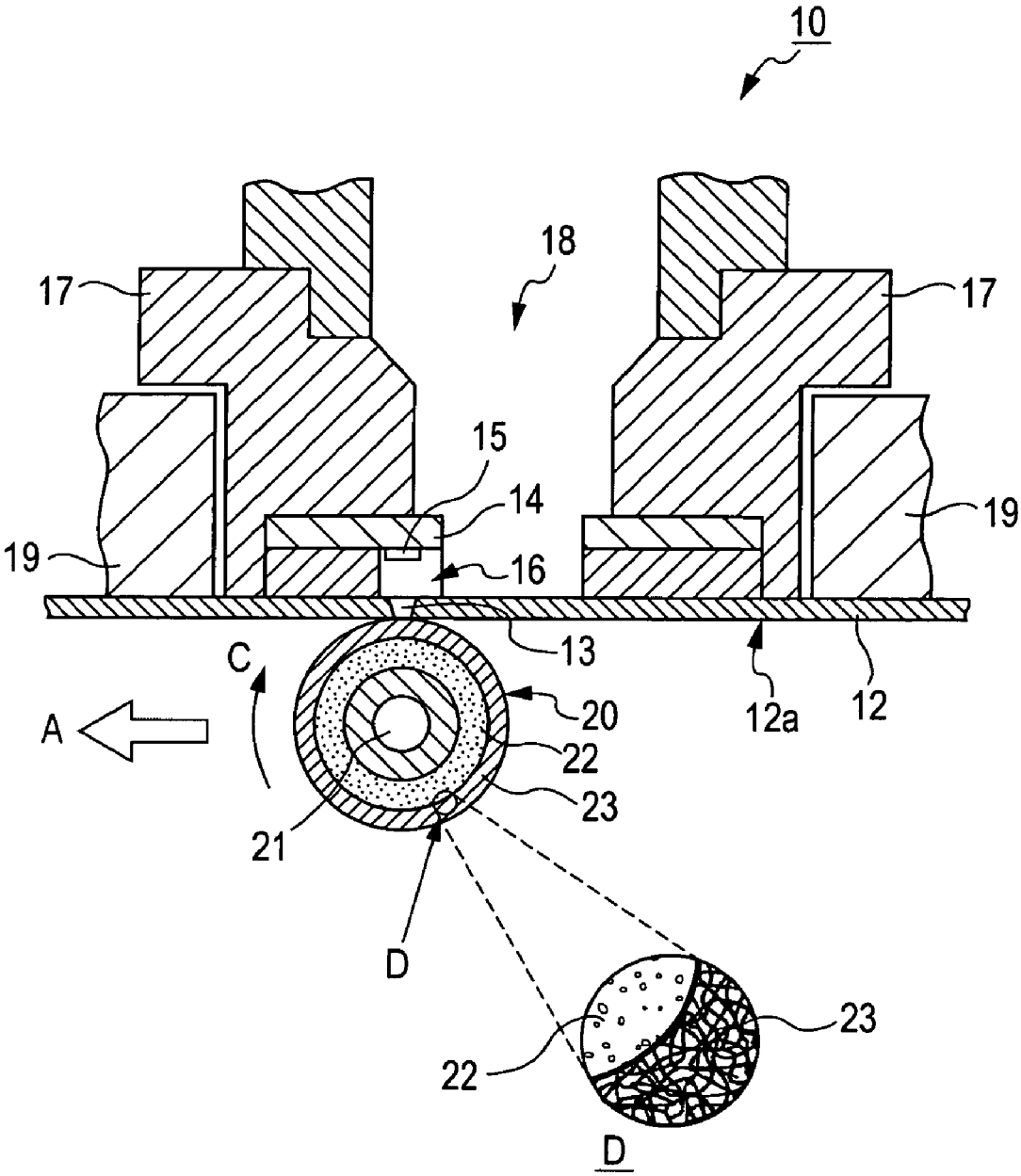
FIG. 3 is an enlarged sectional view of the vicinity of a nozzle surface of a print head shown in FIG. 2.

FIG. 3 is an enlarged sectional view of the vicinity of the nozzle surface 12*a* of the print head 10 shown in FIG. 2. Above the nozzle member 12, a head chip 14 is disposed in correspondence with the location of the ink discharge nozzles 13.

The head chip 14 includes a logic circuit which controls ink discharge on the basis of a print signal and a transistor for driving a heating resistor 15 (described later). The heating resistor 15 is disposed so as to oppose the ink discharge nozzles 13. When the heating resistor 15 is heated, discharge energy is applied to ink in an ink compressing chamber 16 in order to discharge ink drops from the ink discharge nozzles 13.

A flow path plate 17 is disposed on the head chip 14, and defines an ink flow path 18 for supplying ink in the ink tanks 9 shown in FIG. 2 to the ink compressing chamber 16. Although, in FIG. 3, the flow path plate 17 is separated into a left portion and a right portion, the left and right portions may be connected into an integral structure. The flow path plate 17 is interposed between head frames 19 and 19 supporting the nozzle member 12.

As shown in FIG. 2, the head cap 11 is removably mounted to the lower surface of the print head 10. The head cap 11 is movable relative to the print head 10 in the directions of arrows A and B, and protects the nozzle surface 12*a* of the print head 10 when it is mounted to the print head 10 as shown in FIG. 2. More specifically, the head cap 11 has an elongated box shape having upstanding portions at its four peripheral sides, is entirely formed of, for example, hard resin, and has a cleaning roller 20 disposed therein.

The cleaning roller 20 constitutes a cleaner for cleaning the nozzle surface 12*a* of the print head 10 while moving relative to the nozzle surface 12*a*, is cylindrical, is mounted to one side in the head cap 11 in the longitudinal direction of the head cap 11, and is parallel with the longitudinal direction of the nozzle surface 12*a*. The cleaning roller 20 has a rotary shaft 21 and a shaft bearing 22. The rotary shaft 21 is formed of hard plastic or metal and is disposed at the central portion of the cleaning roller 20. As shown in 2, the shaft bearing 22 is disposed in a standing manner from the bottom surface of the head cap 11 and holds the rotary shaft 21.

As shown in FIG. 3, a cushion 22, formed of a resilient material such as porous urethane foam or rubber, is disposed around the outer peripheral surface of the rotary shaft 21 of the cleaning roller 20, and a fibrous absorbing member 23 is disposed around the outer peripheral surface of the cushion 22. When the cleaning roller 20 moves in the direction of arrow A while rotating in the direction of arrow C, the absorbing member 23 comes into contact with the nozzle surface 12*a*, and wipes and cleans off any ink drops or dirt such as foreign matter adhered to the nozzle surface 12*a*. The absorbing member 23 is formed by condensing fibrous material which absorbs liquid, such as chemical fiber including polyethylene.

As shown by an enlarged portion D in FIG. 3, a plurality of cells of different sizes are formed between each fiber in the fibrous absorbing member 23.

The absorbing member 23 may be formed of cloth formed by mechanically or chemically processing fibrous sheets by heat without forming threads and joining them by making use of a force intertwining the fibers themselves or with an adhesive. In other words, the absorbing member 23 may be formed of nonwoven fiber. In this case also, a plurality of cells of different sizes are formed in the absorbing member 23 formed of nonwoven fiber.

The cleaning roller 20 moves along the nozzle surface 12*a* as it rotates while being in press-contact with the nozzle surface 12*a*. The absorbing member 23 constituting the outer peripheral surface of the cleaning roller 20 provides large cells formed by the fibers having randomly different sizes. The cells of different sizes make it possible to wipe any dirt adhered to the nozzle surface 12*a* of the nozzle member 12. Capillary force generated by these cells is exerted upon the nozzle surface 12*a*.

As mentioned above, since the cleaning roller 20 is cylindrical, it is possible to bring the fibers in various states in the surface of the absorbing member 23 into contact with the nozzle surface 12*a*. This allows the fibrous absorbing member 23 matching the size and shape of ink drops and dirt adhered to the nozzle surface 12*a* to come into contact with the nozzle surface 12*a*. Therefore, as a plurality of wiping operations are repeated, even if dirt or ink drops that cannot be easily removed are adhered to the nozzle surface 12*a*, the dirt or ink drops can be removed as by coming into contact with the absorbing member 23 in a states that matches the dirt or ink drops.

Figure 4:
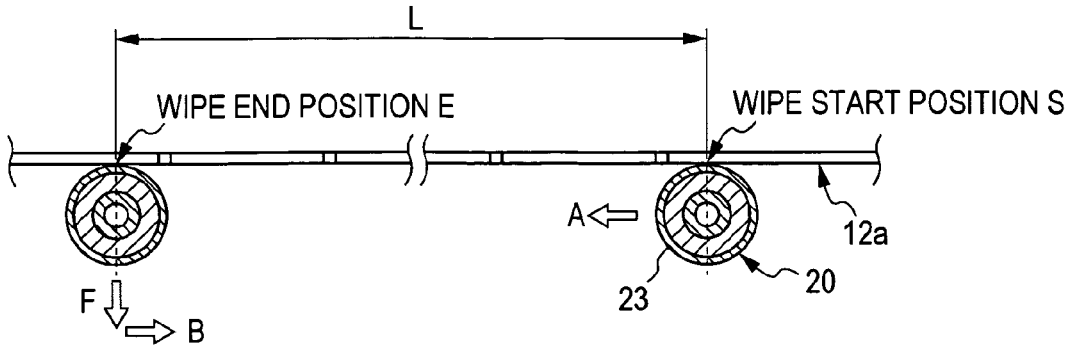
FIG. 4 illustrates a wiping operation with a length that is an integral multiple of a cross-sectional boundary length of a cleaning roller shown in FIG. 3 differing in value from a distance of movement of the cleaning roller along the nozzle surface.

Here, as shown in FIG. 4, a length that is an integral multiple of a cross-sectional boundary length of the cleaning roller 20 differs in value from a distance that the cleaning roller 20 moves as it rotates while being in press-contact with the nozzle surface 12*a*. For example, if a distance of movement of the cleaning roller 20 from a wipe start position S where wiping is started with respect to the nozzle surface 12*a* and a wipe end position E where the wiping ends with respect to the nozzle surface 12*a* is L, a cross-sectional boundary length of the cleaning roller 20 is a, the rotational speed of the cleaning roller 20 is n, and α is a predetermined length, the following relationship is established:

$$L=n\times a+\alpha \text{ (where } \alpha\neq a)$$

Therefore, as shown in FIG. 4, when the cleaning roller 20 at the wipe start position S moves in the direction of arrow A as it rotates while being in press-contact with the nozzle surface 12*a*, reaches the wipe end position E, moves downward in the direction of arrow F, moves in the direction of arrow B while out of contact with the nozzle surface 12*a*, and returns to the wipe start position S, and these movements are repeated, a portion of the absorbing member 23 that contacts the nozzle surface 12*a* at the wipe start position S can be different from a previous portion of contact of the absorbing member 23 with the nozzle surface 12*a* at the wipe start position S.

Therefore, by moving the cleaning roller 20 again in the direction of arrow A and wiping the nozzle surface 12*a*, the fibers in various states in the surface of the absorbing member 23 come into contact with the nozzle surface 12*a*, so that any dirt or ink drops adhered to the nozzle surface 12*a* can be removed.

Consequently, as a plurality of wiping operations are repeated, dirt that cannot be easily removed can be removed with the fibrous absorbing member 23, so that the cleaning effect at the nozzle surface 12*a* is enhanced.

Figure 5:
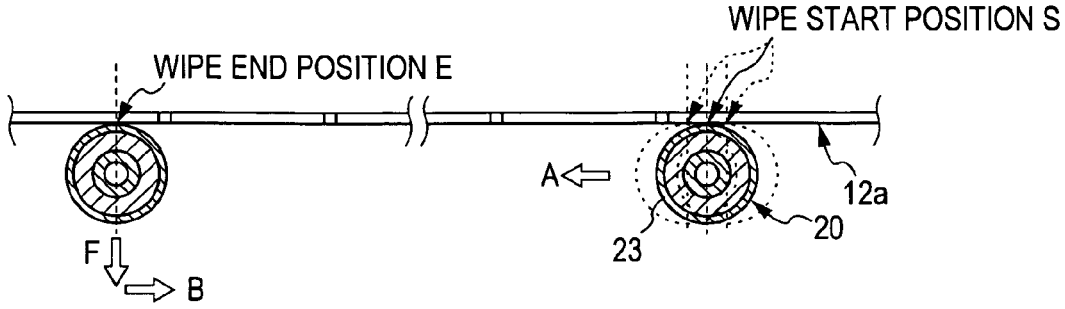
FIG. 5 illustrates the wiping operation with a wipe start position where the cleaning roller shown in FIG. 3 starts wiping the nozzle surface differing from a previous wipe start position.

As shown in FIG. 5, the cleaning roller 20 can wipe the nozzle surface 12*a* by making the wipe start position S where the cleaning roller 20 starts wiping the nozzle surface 12*a* different from a previous wipe start position S. Therefore, when the cleaning roller 20 repeatedly cleans the nozzle surface 12*a*, the wipe start position S of the cleaning roller 20 is changed each time the cleaning roller 20 wipes the nozzle surface 12*a*. Consequently, similarly to the above-described case, as a plurality of wiping operations are repeated, dirt that cannot be easily removed can be removed with the fibrous absorbing member 23, so that the cleaning effect at the nozzle surface 12*a* is enhanced.

As shown in FIG. 2, an ink receiver 30 is disposed along the bottom surface of the head cap 11, receives ink drops preliminarily discharged from the ink discharge nozzles 13 of the print head 10 over the entire bottom surface of the head cap 11, and is formed of a material having moisture absorption characteristics such as sponge.

This makes it possible to prevent any ink preliminarily discharged from the ink discharge nozzles 13 of the print head 10 from splashing and to absorb the ink so that it does not accumulate at the bottom surface of the head cap 11. Therefore, it is possible to prevent the problem of the preliminarily discharged ink being splashed at the ink receiver 30 and re-adhering to the nozzle surface 12*a*.

Figure 6:
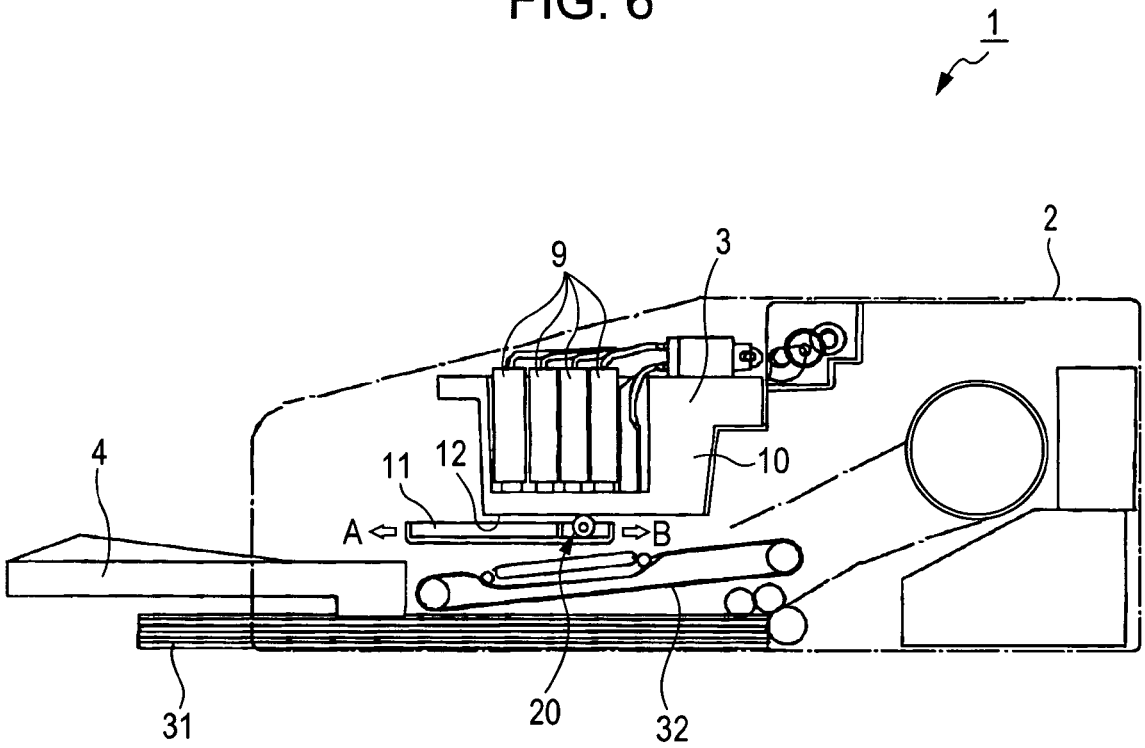
FIG. 6 is a partial sectional side view showing a state in which the head cartridge is accommodated in the accommodation section of the inkjet printer shown in FIG. 1.

Next, an operation for maintaining the liquid discharge performance of the liquid discharger having such a structure will be described with reference to FIGS. 6 and 7. The head cartridge 3 is accommodated so as to be fixedly held in the accommodation section 8 of the printer body 2 shown in FIG. 1 in the direction of arrow Z. The recording-sheet tray 4 is accommodated in the tray insertion slot 5. A conveying belt 32 for transporting recording sheets 31 in the recording-sheet tray 4 towards the lower side of the print head 10 is in its lowered tilted state.

Figure 7A:
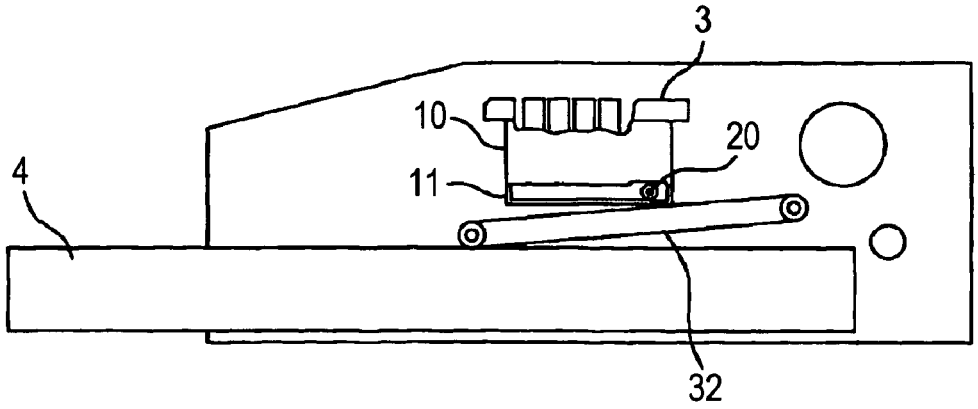
FIGS. 7A to 7C illustrate an operation for maintaining the ink discharge performance of the print head by the movement of a head cap shown in FIG. 6.

Next, when an image is to be formed on a recording sheet 31 by discharging ink from the print head 10, the head cap 11 is first moved in the direction of arrow A in order to remove the head cap 11 from the print head 10 and withdraw it from the nozzle member 12. In other words, the head cap 11 mounted to the lower surface of the print head 10 in a waiting state shown in FIG. 7A is moved in the direction of arrow A relative to the print head 10 as shown in FIG. 7B.

Figure 7B:
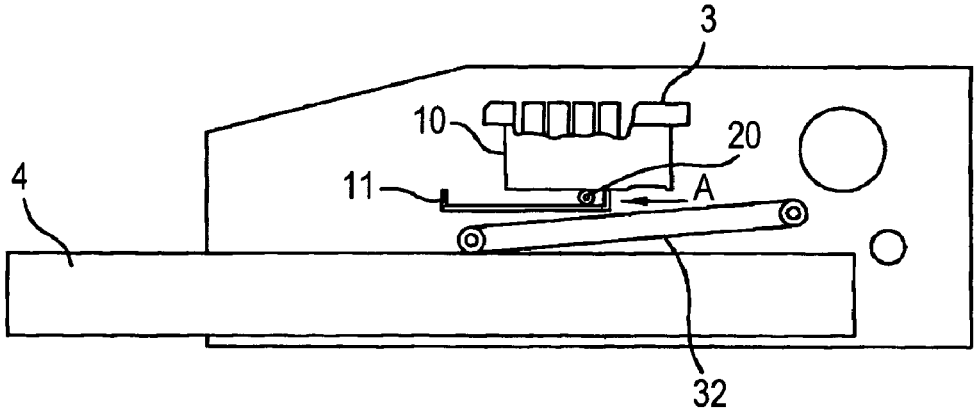

Here, since the cleaning roller 20 is disposed in the head cap 11, as shown in FIG. 7B, as the head cap 11 opens by moving in the direction of arrow A, the cleaning roller 20 moves over the entire length of the nozzle surface 12*a* as it rotates while being pushed with a proper pressure. As a result, any thickened and hardened ink or any dirt adhered to the nozzle surface 12*a* is wiped with the cleaning roller 20, thereby cleaning the nozzle surface 12*a*.

Here, since capillary force generated by the randomly sized cells produced by each fiber in the absorbing member 23 disposed at the outer peripheral surface of the cleaning roller 20 uniformly acts upon the nozzle surface 12*a*, any ink on the nozzle surface 12*a* is frequently uniformly wiped, so that the cleaning effect at the nozzle surface 12*a* of the print head 10 is enhanced.

Here, since, as in the related art disclosed in Patent Document 2, porous cellular material in which the average of the diameters of cells is controlled is rarely used at the surface where the cleaning roller contacts the print head, products of the same standard can be easily mass-produced.

As shown in FIG. 4, since a length that is an integral multiple of the cross-sectional boundary length of the cleaning roller 20 differs in value from the distance L that the cleaning roller 20 moves as it rotates while being in press-contact with the nozzle surface 12*a*, it is possible to repeatedly wipe the nozzle surface by varying the portion where the outer peripheral surface of the cleaning roller contacts the nozzle surface 12*a*.

Therefore, it is possible to repeatedly wipe the nozzle surface 12*a* by varying the portion where the absorbing member 23 contacts the nozzle surface 12*a*. Therefore, as the plurality of wiping operations are repeated, even dirt that cannot be easily removed can be removed with the absorbing member 23 of the cleaning roller 20, so that the cleaning effect at the nozzle surface 12*a* can be enhanced.

As shown in FIG. 5, since the cleaning roller 20 may wipe the nozzle surface 12*a* with the wipe start position S where the cleaning roller 20 starts wiping the nozzle surface 12*a* differing from the previous wipe start position, it is possible to wipe the nozzle surface 12*a* by varying the wipe start position S each time the nozzle surface 12*a* is wiped. Therefore, it is possible to provide similar effects.

Figure 7C:
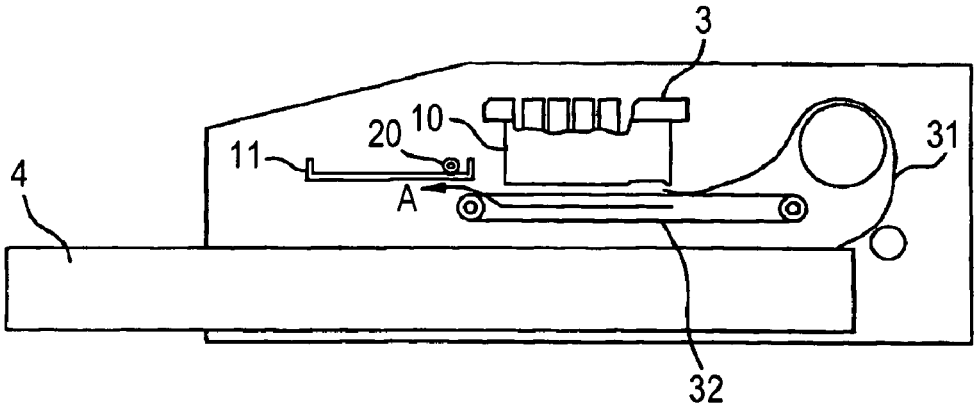

After the cleaning operation, as shown in FIG. 7C, the head cap 11 is withdrawn to its withdrawal position. In this state, after raising the conveying belt 32, a recording sheet 31 in the recording tray 4 is transported towards the lower surface of the print head 10. Then, ink drops are discharged onto the transported recording sheet 31 from the ink discharge nozzles 13 of the print head 10 in order to form an image. Here, since the nozzle surface 12*a* of the print head 10 is properly cleaned, it is possible to enhance the stability with which the ink drops are discharged from the print head 10, so that a high-quality image can be formed.

Although, in the foregoing description, the fibrous absorbing member 23 is disposed around the outer peripheral surface of the cushion 22 disposed around the outer periphery of the rotary shaft 21 of the cleaning roller 20, the fibrous absorbing member 23 may be simultaneously formed and integrated with the cushion 22. In this case also, similar effects are provided.

Although, in the description above, the inkjet printer is taken as an example, the present invention may be applied to any device as along as it discharges liquid from liquid discharge nozzles of a liquid discharge head. For example, the present invention may be applied to a copying machine or a facsimile machine whose recording method is an inkjet method.

The liquid discharged from the liquid discharge nozzles of the liquid discharge head of the liquid discharger is not limited to ink. Therefore, the present invention may be applied to liquid dischargers for discharging other types of liquids as long as the liquid dischargers form dots or a row of dots by discharging the liquid in a liquid chamber. For example, the present invention may be applied to a liquid discharger for discharging a solution containing DNA to a pallet in, for example, DNA examination or a liquid discharger for discharging a liquid containing conductive particles for forming a wiring pattern on a printed wiring board.

It should be understood by those skilled in the art that various modifications, combinations, sub-combinations and alterations may occur depending on design requirements and other factors insofar as they are within the scope of the appended claims or the equivalents thereof.

What is claimed is:

1. A cleaner of a liquid discharge head having a nozzle surface provided with a liquid discharge nozzle for discharging a predetermined liquid, the cleaner cleaning the nozzle surface by moving relative to the liquid discharge head, the cleaner comprising a cleaning roller for wiping the nozzle surface, wherein, a surface of the cleaning roller which comes into contact with the nozzle surface is formed of a fibrous absorbing member, and the cleaning roller wipes the nozzle surface from a wipe start position where the cleaning roller starts wiping the nozzle surface with a portion of the cleaning roller surface which is different from that cleaning roller surface presented at a previous wipe start position.

2. The cleaner according to claim 1, wherein the cleaning roller moves on the nozzle surface as the cleaning roller rotates while being in press-contact with the nozzle surface.

3. The cleaner according to claim 1, wherein a length that is an integral multiple of a cross-sectional boundary length of the cleaning roller differs in value from a distance that the cleaning roller moves as the cleaning roller rotates while being in press-contact with the nozzle surface.

4. A liquid discharger for discharging a predetermined liquid from a liquid discharge nozzle, the liquid discharger comprising:

a liquid discharge head having a nozzle surface provided with the liquid discharge nozzle for discharging the predetermined liquid; and a cleaner for cleaning the nozzle surface by moving relative to the liquid discharge head, wherein, the cleaner includes a cleaning roller for wiping the nozzle surface, a surface of the cleaning roller which comes into contact with the nozzle surface of the liquid discharge head is formed of a fibrous absorbing member, the cleaning roller moves in a direction perpendicular to a longitudinal direction of the nozzle surface, and the cleaning roller wipes the nozzle surface from a wipe start position where the cleaning roller starts wiping the nozzle surface with a portion of the cleaning roller surface which is different from that cleaning roller surface presented at a previous wipe start position.

5. The liquid discharger according to claim 4, wherein the cleaning roller moves on the nozzle surface as the cleaning roller rotates while being in press-contact with the nozzle surface.

6. The liquid discharger according to claim 4, wherein a length that is an integral multiple of a cross-sectional boundary length of the cleaning roller differs in value from a distance that the cleaning roller moves as the cleaning roller rotates while being in press-contact with the nozzle surface.

* * * * *